US005813950A

United States Patent [19]

Parker

[11] Patent Number: 5,813,950

[45] Date of Patent: Sep. 29, 1998

[54] GRIP ASSIST APPARATUS

[76] Inventor: Michael S. Parker, HC 32 Box 200, Sorrento, Me. 04677

[21] Appl. No.: 853,808

[22] Filed: May 9, 1997

Related U.S. Application Data

[63] Continuation of Ser. No. 593,442, Jan. 29, 1996, abandoned.

[51] Int. Cl.[6] ..... A63B 21/00; A41D 13/08

[52] U.S. Cl. ..... 482/93; 2/20; 294/25

[58] Field of Search ..... 482/92, 93, 105, 482/106, 139; 2/20, 161.1; 294/25

[56] References Cited

U.S. PATENT DOCUMENTS

| | | | |
|---|---|---|---|
| 4,194,308 | 3/1980 | Karlsson | 36/9 R |
| 5,350,343 | 9/1994 | DaSilva | 482/105 X |

FOREIGN PATENT DOCUMENTS

| | | | |
|---|---|---|---|
| 1270602 | 6/1990 | Canada | 482/106 |
| 3443429 | 8/1986 | Germany | 1/20 |

*Primary Examiner*—Richard J. Apley
*Assistant Examiner*—John Mulcahy
*Attorney, Agent, or Firm*—William B. Ritchie; Michael J. Persson

[57] ABSTRACT

A grip assist apparatus designed to strengthen the weight lifter's grip and prevent a weight training injury by providing support to the wrist and hand while protecting the palm of the hand. The grip assist also allows the lifter free movement of his hands when he is not actually gripping the weight bar. The apparatus features a flexible gripping portion that covers the palm of the lifter. The gripping portion provides a non-slip surface that is tacky to the touch. A thicker, flexible top end of the gripping portion comes in direct contact with the weight bar and can be easily positioned between the bar and lifter's hand or partially positioned around the bar by the tips of the fingers of the same hand, depending on the lifter's preference. The grip assist apparatus also has a padded wrist portion having two elongated flaps such that when the flaps are tightened around the lifter's wrist and base of the hand, they form a funnel-like opening to tighten against and thus support the wrist and hand when in use and allow free circulation to the hand.

20 Claims, 5 Drawing Sheets

GRIP ASSIST APPARATUS

RELATED APPLICATIONS

This is a file wrapper continuation of application Ser. No. 08/593,442, filed Jan. 29, 1996, and now abandoned.

BACKGROUND OF THE INVENTION

1. Field of the Invention

The invention relates to the field of weight training and, more particularly, relates to grip assist apparatus that enable a weight lifter to increase grip strength.

2. Description of the Related Art

Weight training has become a widely practiced activity for both men and women. In addition to being a sport in itself, weight training is also utilized as a conditioning and strengthening exercise for other sports, such as football, basketball and baseball. Furthermore, athletes who rely on agility, such as tennis players, also benefit from weight training.

In sports, protective equipment is utilized to prevent injury to the participant. With respect to weight training, protective equipment is also needed since all the joints of the body may be subjected to extreme forces. In particular, the wrist joint is subjected to these extreme forces any time the trainee's hands utilize a weight bar during the course of weight training.

In weight training, the weightlifter utilizes the small muscles of the forearm to control the finger flexors, which cause the fingers to grip the bar carrying the weight. These small muscles are required to carry the weight in order to work a larger muscle group such as the large back muscle. Since the large muscle groups require more weight and a greater number of repetitions to reach their maximum potential than the smaller forearm muscles can provide, the smaller muscle group fatigues or fails before maximum potential of the larger muscle groups is reached.

One type of apparatus for assisting a weight lifter in gripping the weights currently in use is a cylinder-shaped wrist band that cinches and fastens about the wrist. This device can restrict circulation to the hand.

Another type of apparatus is a gripping strap that is folded around the weight lifting bar. Since this device collapses under its own weight, it is very difficult to wrap around the lifting bar with one hand. To be effective, the gripping strap that is folded around the lifting bar must be able to free stand up in front of the hand in order to be easily wrapped around the lifting bar with the tips of the fingers on the same hand.

None of the prior art grip assist devices enable a user to position it easily with the same hand; provide protection for the palm of the hands while supporting the wrist; provide unrestricted circulation to the hand; provide a durable, permanently non-slip, gripping surface, and allow the user to easily release the weight by simply opening the fingers. These and other needs are satisfied by the present invention.

SUMMARY OF THE INVENTION

It is an aspect of the invention to provide a grip assist apparatus to support the user's wrist during weight training.

It is another aspect of the invention to provide a grip assist apparatus that is easy to secure to the user's wrist.

It is another aspect of the invention to provide a grip assist apparatus that is flexible, yet supportive enough to free stand in front of the hand.

It is another aspect of the invention to provide a grip assist apparatus that is self supporting, yet easily folded around the lifting bar with the tips of the fingers on the hand in which it is affixed.

It is another aspect of the invention to provide a grip assist apparatus that is durable and strong.

It is another aspect of the invention to provide a grip assist apparatus that is contoured to the user's hand and can be used in both pulling and pushing exercises.

It is another aspect of the invention to provide a grip assist apparatus that accommodates a wide variety of hand sizes.

It is another aspect of the invention to provide a grip assist apparatus that does not restrict the user's hand while remaining attached to the wrist but not in immediate use.

It is another aspect of the invention to provide a grip assist apparatus that is made of a non-slip material that has a "tacky" feel.

It is another aspect of the invention to provide a grip assist apparatus that is inexpensive to manufacture.

It is another aspect of the invention to provide a grip assist apparatus that accommodates user comfort so as not to restrict circulation to the hand.

It is another aspect of the invention to provide a grip assist apparatus that is lightweight.

Finally, it is final aspect of the invention to provide a grip assist apparatus in which the weight lifting bar can be easily released from the weight lifter's grasp by simply opening and releasing the weightlifter's hand grip from around the bar.

The invention is a grip assist apparatus designed to prevent a weight training injury to the trainee's wrist by producing greater gripping strength to the hands and support to the wrist while also allowing the user free movement of his hands when he is not actually grabbing the weight bar. The apparatus comprises a gripping portion that covers the palm of the user, wherein the top portion comes in direct contact with the weight bar while the gripping portion extends from the fingers to just below the wrist. The grip assist apparatus also comprises a thicker outer and upward end for greater security. A wrist portion having two elongated flaps is provided such that when the flaps are tightened around the user's wrist and base of the hand, they form a funnel-like opening to tighten against and thus supporting the wrist and hand when in use.

DETAILED DESCRIPTION OF THE INVENTION

Figure 1:
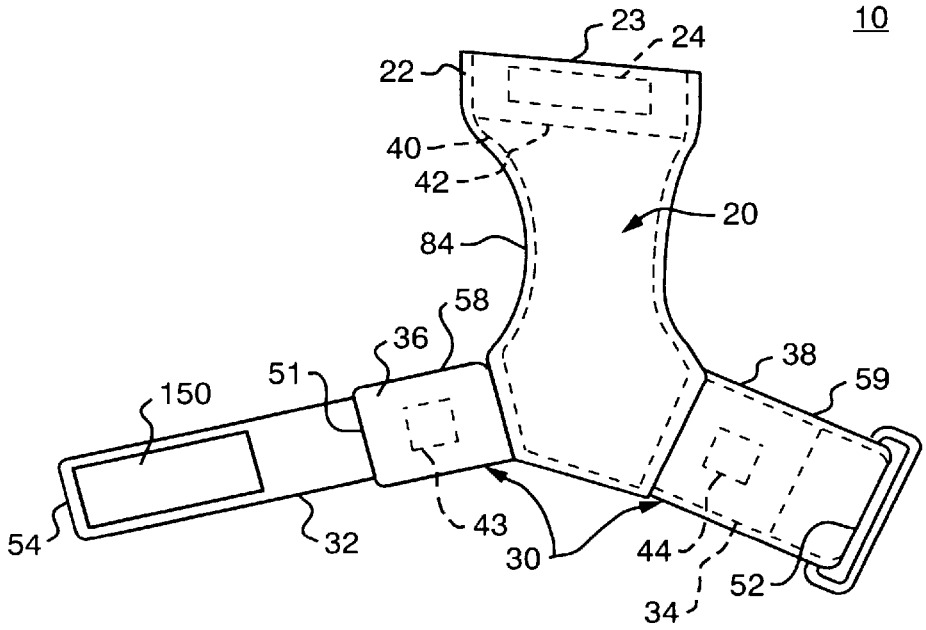
FIG. 1 is a top view of a right-handed grip assist apparatus fully extended.

Referring to FIG. 1, a top view of a right-handed grip assist apparatus 10 is shown in a fully extended position. The left-handed grip is different only as necessary to the user's left hand. Since invention 10 is designed to fit the hand in a particular manner, it is preferable that the right and left versions are marked accordingly to prevent a user from mistaking a left for a right. Grip assist apparatus 10 comprises gripping portion 20 and wrist portion 30. Wrist portion 30 has two elongated flaps, 32 and 34, extending from palm portion 20. A left-handed and a right-handed version is preferred if two-handed exercises are to be performed.

Palm portion 20 is designed to contour to the shape of the hand. However, this is not critical and palm portion 20 could be a non-contoured shape as well. Contour 84 is designed to contour the user's thumb. Top portion 22 is sized to cover a majority of the base of the fingers across the width of the hand while the opposite side is to be in contact with the weight bar, so that when the user bends his/her fingers around the bar, the thicker top portion 22 provides extra security from slipping. Typically, top portion 22 extends down approximately one inch from edge 23. Correspondingly, edge 23 is approximately three and a quarter inches in width. For very large or petite hands, these dimensions would have to vary accordingly, but overall, one size would be suitable to accommodate a larger variety of hand sizes.

Figure 4:
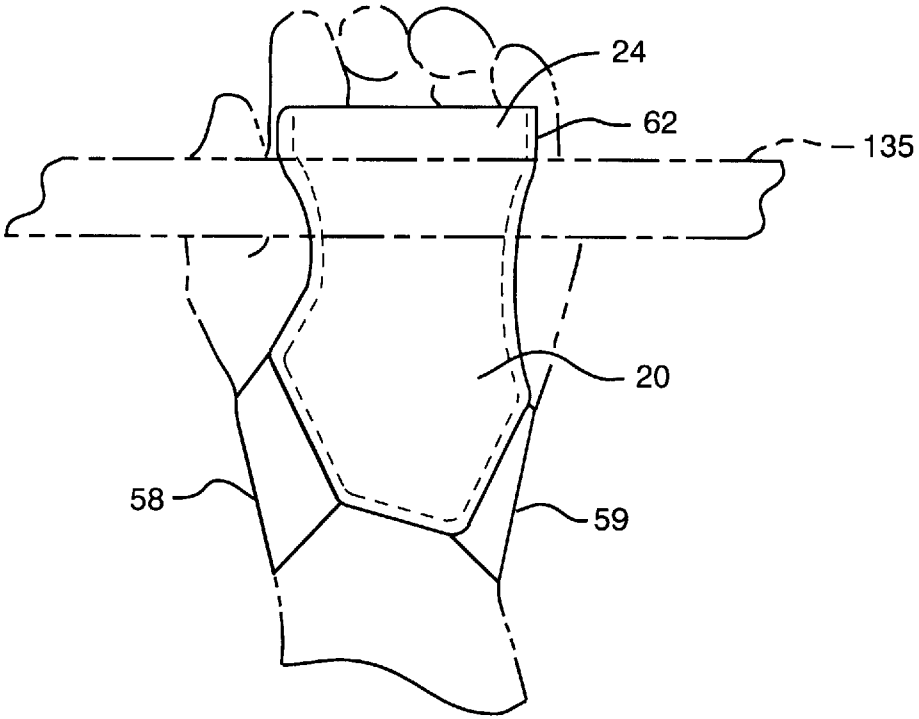
FIG. 4 is an isometric view showing the grip assist apparatus being used to lift a weight bar with the gripping portion between the user's hand and the bar for pushing exercises.
Figure 4A:
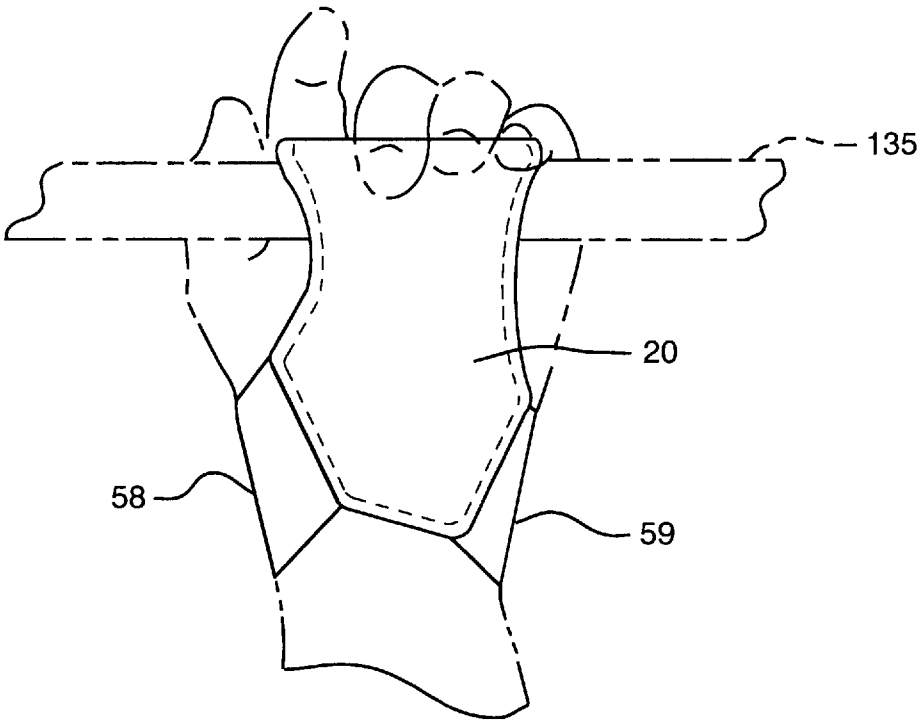
FIG. 4*a* is an isometric view showing the grip assist apparatus being used to lift a weight bar with the gripping portion wrapped around the bar for pulling exercises.
Figure 5:
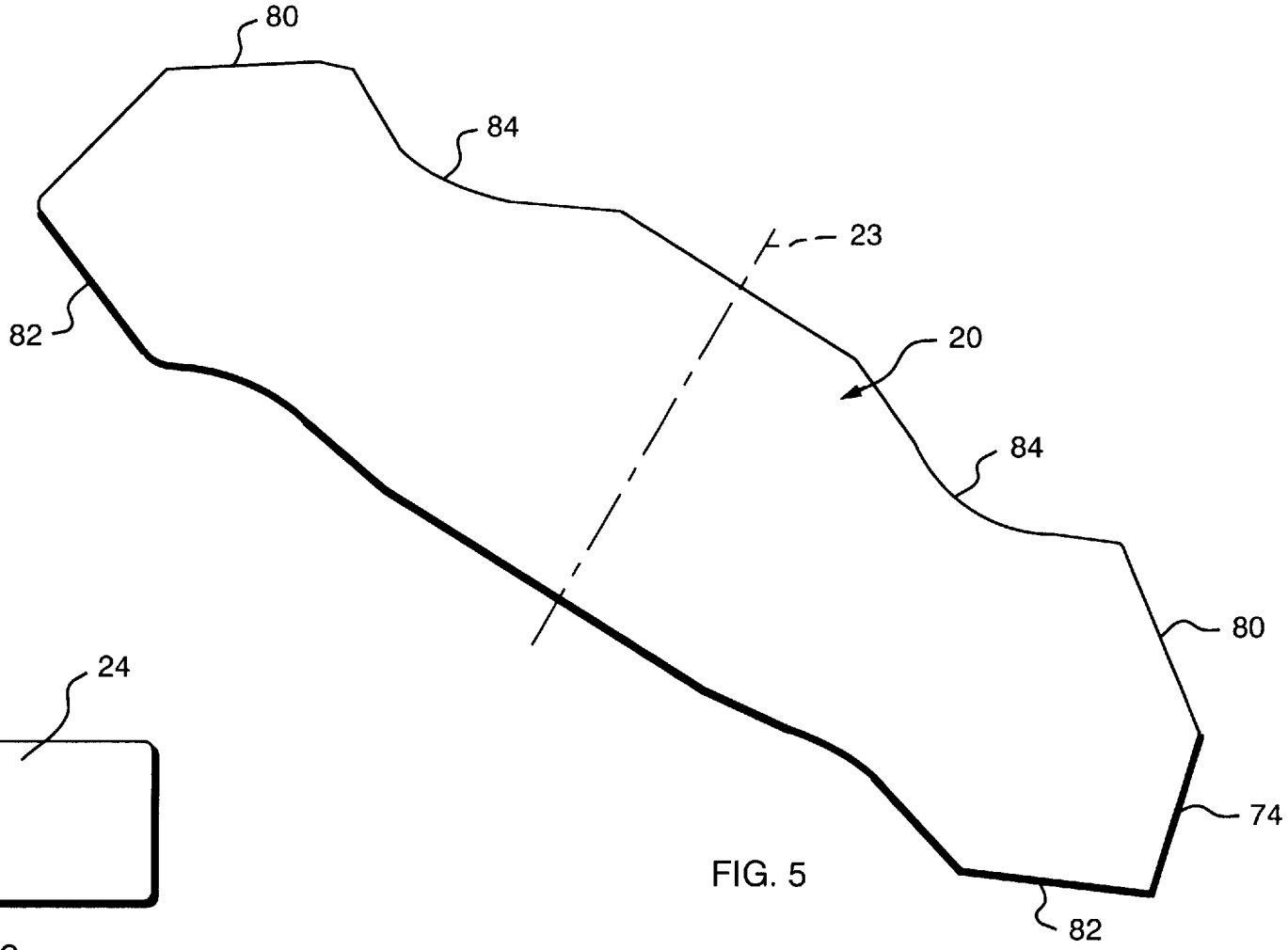
FIG. 5 is a detail of the gripping portion of the apparatus.

Palm portion 20 is preferably formed using a single piece of material folded over to form edge 23 as shown in detail in FIG. 5. The preferable material of palm portion 20 is chlorobutyl rubber, which provides a tacky, sticky surface to allow palm portion 20 to adhere to the palm of the user's hand instead of sliding around while in use. While other materials can be used, the inventor has found that many materials such as leather or other synthetics lose their non-slip ability once these materials have been used for a period of time. The chlorobutyl rubber continues to retain its non-slip properties despite substantial use. Palm portion 20 remains flexible, yet rigid to the point that it does not bend under its own weight. The self-supporting feature of palm portion 20 allows the user to stand in front of a weight bar and not have to actively position top portion 22 in place using both hands. The self-supporting feature is obtained partially by the selection of the material used for palm portion 20. However, more flexible material would also be self-supporting due to the method of attachment used. When the user places his or her hands on the bar, top portion 22 will naturally be in a position at the base of the user's fingers for positioning on the weight bar. Since top portion 22 is flexible yet self-supporting, the lifter can either place top portion 22 between the bar and user's palm or wrap top portion 22 around the bar, as shown in FIGS. 4 and 4*a*, respectively.

Figure 6:
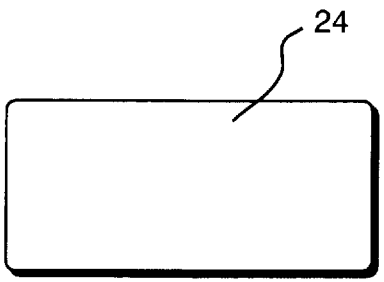
FIG. 6 is a detail of the insert used in the gripping portion.

Top portion 22 contains reinforced insert 24 (shown in detail in FIG. 6) that is sandwiched in place when the single piece of material of palm portion 20 is folded over and sewn together. Insert 24 is approximately 2 inches long and about ¾ of an inch wide and about ⅛ of an inch thick. Rubber or other resilient material is preferable. Stitched seams 40 and 42 securely hold palm portion 20 together which in turn holds reinforced insert 24 in place. Reinforced insert 24 allows top portion 22 to retain its flexibility while effectuating an even distribution of the forces resulting from the weight bar on the hand.

Wrist cushions 36 and 38 are attached to palm portion 20 via seam 40 to prevent discomfort to the user while flaps 32 and 34 are tightened around the user's wrist. Likewise, stitched seams 43 and 44 securely attach cushions 36 and 38 to wrist flaps 32 and 34 respectively. Note that while all seams are preferably stitched, other methods of fastening such as gluing, welding, etc. would also be suitable. Further, if parts are molded, then, one or more seams might be unnecessary.

Cushions 36 and 38 are preferably made out of Neoprene, which is hypo-allergenic. Other types of material offering such cushioning and non-allergenic properties would also be acceptable. Cushions 36 and 38 are approximately equal in same size. The width of cushions 36 and 38, designated by edges 51 and 52, are sized to be slightly larger than edges 54 and 55 (reference FIG. 2) of flaps 32 and 34. Edges 54 and 55 are approximately one and a half inches in length. Thus, measurement of edges 51 and 52 are to exceed approximately one and a half inches; a measurement of one and three quarter inches would be suitable. The length of edges 58 and 59 are selected so that when wrists flaps 32 and 34 are secured about the user's wrist, edges 51 and 52 are in close proximity to each other. It is preferred that the two cushion edges do not overlap in order to prevent buckling of the material and to also prevent user discomfort.

Section 150 is sewn onto flap 32 to provide a flat space for which indica may be placed thereon. For example, the indicia could provide for designation of either the left handed or right handed apparatus as discussed above and to also provide space for a manufacturing logo.

Figure 2:
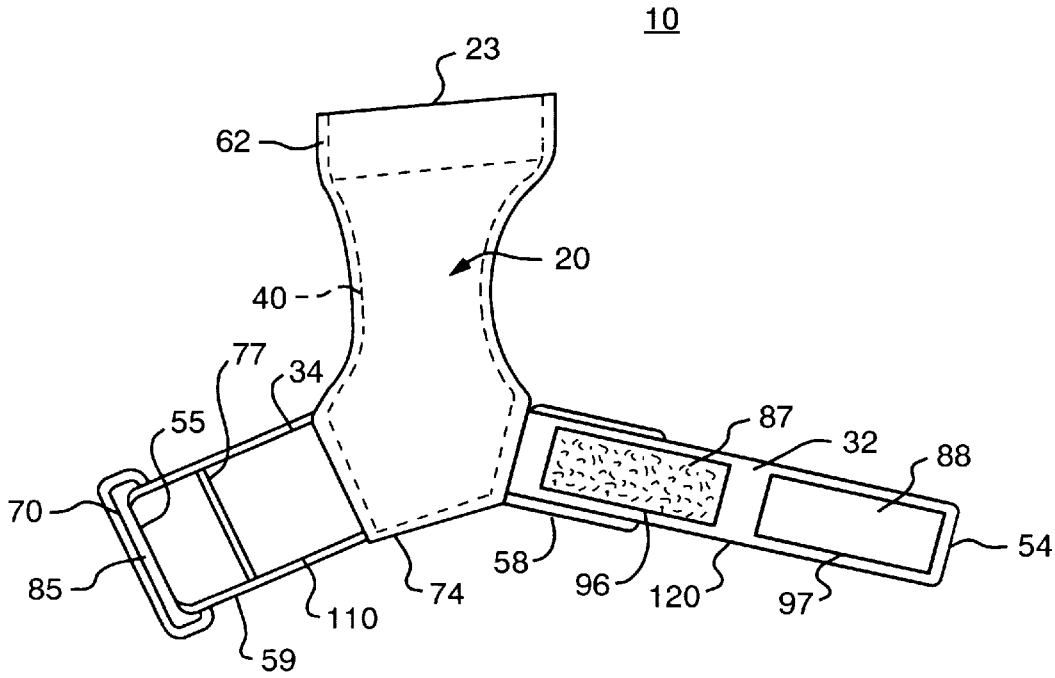
FIG. 2 is a bottom view of the grip assist apparatus of FIG. 1 fully extended.

FIG. 2 is a bottom view of grip assist apparatus 10 in a fully extended position. As previously stated, wrist portion 30 consists of wrist flaps 32 and 34 and also wrist cushions 58 and 59. All items are securely attached to palm portion 20 via stitched seam 40. Flap 34 extends out from palm portion 20 approximately four and one quarter inches. The buckle end of flap 34 is folded over and sewn along seam 77 so that buckle 70 is attached. Buckle 70 is a solid piece of plastic. Other suitable materials exhibiting similar qualities such as strength while being light weight would also be acceptable.

Flap 34 is rectangular shaped and extends approximately eight and a half inches from base portion 20. The length must be long enough so that flap 34 can be inserted through opening 85 of buckle 70 and, then, folded over and locked onto itself. Once inserted through opening 85, flap 34 is pulled tight against the user's wrist. In the preferred embodiment, a hook and loop fastener such as VELCRO is used to securely hold flap 34 in place. The flaps can also be secured with any type of fastener such as pins, hooks and eyes, or snaps. However, the most secure fastening is provided by the use of the hook and loop fastener to achieve a firm and quick fastening. Sections 87 and 88 represent the required two portions of hook and the loop portions necessary to attach to each other. Sections 87 and 88 are securely sewn in place to flap 34. Edges 96 and 97 are each approximately three and a half inches long with about an inch distance separation between them. The exact dimensions of wrist flaps 32 and 34 can vary as long as grip assist apparatus 10 is securely attached to the user's wrist without subjecting the user to any undue discomfort.

Figure 3:
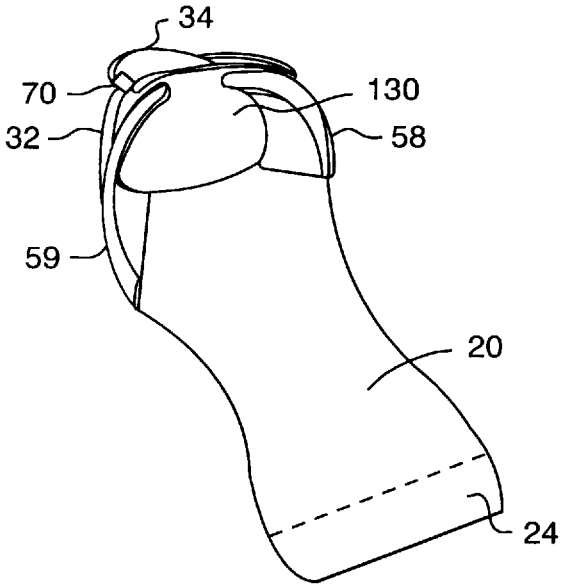
FIG. 3 is an isometric view of the grip assist apparatus illustrating the funnel-like opening designed to grab the user's wrist.

Edge 110 of rectangular shaped flap 32 is parallel with edge 74 of palm portion 20. However, an obtuse angle of approximately one hundred and thirty degrees is formed between edge 120 of flap 34 and edge 74. As illustrated in FIG. 3, flaps 32 and 34 form a funnel-like opening 130 when the two flaps are attached to each other. Funnel-like opening 130 serves to grab the user's wrist while in use in order to provide a firm support during weight training. This funnel-shaped positioning that attaches invention 10 up toward the base of the hand prevents the circulation being restricted in the lifter's hand yet while enabling invention 10 to be firmly attached about the wrist.

FIG. 4 is a perspective view of grip assist apparatus 10 attached to a user's wrist. Top portion 62, directly opposite top portion 22 as viewed from the bottom side of apparatus 10, is positioned just at the base of the fingers so that it is in contact with weight bar 135. Palm portion 20 is designed to contour to the shape of the hand and also to extend down far enough from edge 23 such that wrist portion 30 is allowed to permit flaps 32 and 34 to be securely wrapped around the user's wrist and the lower portion of the palm in opposite directions to strengthen support for the wrist. Typically, edge 74 is approximately six and a half inches from edge 23. In FIG. 4*a*, top portion 22 is shown wrapped around weight bar 135. In this position, which is the most typical method of use, the gripping strength of the lifter is increased the greatest amount. However, if the weight lifter needs to release the weight, all the lifter has to do is release the fingers, top portion 22 will unfold, releasing the weight to the floor.

As shown in FIG. 5, palm portion 20 is preferably made from a single piece of chlorobutyl rubber. Contours 84 correspond to the user's thumb. As noted above, edge 80 is cut an acute angle relative to edge 74 such that when flap 32 is attached, a funnel-shape will be provided when invention 10 is fastened about the user's wrist. Similarly, edge 82 must also be cut at an acute angle. While these angles are not critical, it is preferable that edge 82 makes an angle of about 73 degrees relative to edge 74 and edge 80 makes an angle of about 42 degrees relative to edge 74.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed us:

1. A grip assist apparatus for weight lifting to help support and strengthen a weight lifter's grip during weight training exercises comprising:

a non-slip gripping portion having a finger end, a thumb-side wrist attachment end and a non-thumbside wrist attachment end, said gripping portion for covering a palm of a human hand from a plurality of fingers to below a wrist joint, said gripping portion having a variable width which corresponds to the shape of the palm and having a rigidity such that said gripping portion will not bend under its own weight and is thus self-supporting so that when said apparatus is fastened about the lifter's wrist and base of the hand, said gripping portion will stand up in front of the palm and tips of the fingers yet remain in close proximity to the palm and tips of the fingers, independent of the position of the lifter's hand, and wherein said gripping portion is sufficiently flexible to allow said gripping portion to be easily wrapped around a lifting bar using only the tips of the fingers of the human hand on which the apparatus is worn;

a wrist portion comprising a thumb flap and a non-thumb flap, each of said flaps having an attachment end and a free end, the attachment end of said thumb flap being attached to the thumbside attachment end of said gripping portion, the attachment end of said non-thumb flap being attached to the non-thumbside attachment end of said gripping portion, and releasable fastening means, attached to said flaps, for securely fastening said flaps of said wrist and base of the hand of the lifter with the free ends of said flaps facing one another.

2. The grip assist apparatus of claim 1 wherein each attachment end of said gripping portion is angled such that when said flaps of said wrist portion are fastened about the wrist via said fastening means, said flaps and said gripping portion form a funnel-like enclosure around the wrist and base of the hand, having an opening that is larger at the distal end than at the proximal end.

3. The grip assist apparatus of claim 2 wherein said flaps of said wrist portion are each substantially rectangular in shape.

4. The grip assist apparatus of claim 3 wherein said flaps are a cushioned material that is comfortable when said flaps are tightened against the wrist and base of the hand.

5. The grip assist apparatus of claim 4 wherein said gripping portion is formed of a non-slip material having a "tacky" feel.

6. The grip assist apparatus of claim 5 wherein said gripping portion further comprises a thicker flexible portion at the finger end of said gripping portion to distribute the weight on the hand.

7. The grip assist apparatus of claim 6 wherein said fastening means comprises a first belt section having a ring at one end, said first section being attached to one of said flaps, and a second belt section attached to the other of said flaps, wherein said apparatus may be fastened to the wrist by inserting said second belt section through the ring of said first belt section.

8. The grip assist apparatus of claim 7 wherein said second belt section further comprises a first length of a hook-type fastener and a second length of a corresponding loop-type fastener, such that said apparatus can be securely held on the wrist once said second belt section has been inserted through the ring of said first belt section by locking the first length to the second length on said second belt section.

9. The grip assist apparatus of claim 8 wherein said gripping section is fabricated from a single piece of material.

10. The grip assist apparatus of claim 9 wherein the single piece of material used to form said gripping section has an outer perimeter such that said gripping section is formed by overlapping said single piece and then stitched together at the outer perimeter.

11. The grip assist apparatus of claim 10 further comprising a rectangular-shaped rubber insert wherein said insert is placed inside the overlapping single piece at the finger end before it is stitched together.

12. The grip assist apparatus of claim 11 wherein the finger end of said gripping section is substantially thicker than the remainder of said gripping section.

13. A grip assist apparatus for weight lifting to help support and strengthen a weight lifter's grip during weight training exercises comprising:

a non-slip gripping portion, dimensioned to cover a palm of a human hand from a plurality of fingers to below a wrist joint such that movement of a thumb is not impeded, and wherein said gripping portion has a rigidity such that said gripping portion is self-supporting and will remain extended in front of the palm and of the fingers to allow said gripping portion to be manipulated by the human hand on which the apparatus is worn, and wherein said gripping portion is sufficiently flexible to allow said gripping portion to be easily wrapped around a lifting bar using only the tips of the fingers of the human hand on which the apparatus is worn;

a wrist portion; and a releasable fastener, attached to said wrist portion, for securely fastening said wrist portion to the human hand.

14. The grip assist apparatus of claim 13 wherein said wrist portion comprises a thumb flap and a non-thumb flap, each of said flaps having an attachment end and a free end, the attachment end of said thumb flap being attached to a thumbside attachment end of said gripping portion, the attachment end of said non-thumb flap being attached to a non-thumbside attachment end of said gripping portion, and wherein said releasable fastener is attached to said flaps.

15. The grip assist apparatus of claim 14 wherein each attachment end of said gripping portion is angled such that when said flaps of said wrist portion are fastened about the wrist via said fastener, said flaps and said gripping portion form a funnel-like enclosure, around the wrist and base of the hand, having an opening that is larger at a distal end than at a proximal end.

16. The grip assist apparatus of claim 15 wherein said flaps further comprise a cushioned material that is comfortable when said flaps are tightened.

17. The grip assist apparatus of claim 16 wherein said gripping portion further comprises a thicker flexible portion at the finger end of said gripping portion to distribute the weight on the lifter's hand.

18. The grip assist apparatus of claim 17 wherein said gripping section is fabricated from a single piece of material and wherein said single piece of material is overlapped and stitched together to form two layers having a common outer perimeter.

19. The grip assist apparatus of claim 18 further comprising an rectangular-shaped insert, placed between the two layers at a finger end before said layers are stitched together.

20. The grip assist apparatus of claim 19 wherein the finger end of said gripping section is substantially thicker than the remainder of said gripping section.

* * * * *